US007819715B2

(12) United States Patent
Vick

(10) Patent No.: US 7,819,715 B2
(45) Date of Patent: Oct. 26, 2010

(54) CUSHION PERSONAL FLOTATION DEVICE SAVER

(76) Inventor: George D. Vick, 1074 Sea Eagle Watch, Charleston, SC (US) 29412

( * ) Notice: Subject to any disclaimer, the term of this patent is extended or adjusted under 35 U.S.C. 154(b) by 149 days.

(21) Appl. No.: 12/315,396

(22) Filed: Dec. 3, 2008

(65) Prior Publication Data

US 2010/0136864 A1 Jun. 3, 2010

(51) Int. Cl.
*B63C 9/30* (2006.01)

(52) U.S. Cl. ..... 441/127

(58) Field of Classification Search ..... 441/80, 441/88, 127

See application file for complete search history.

(56) References Cited

U.S. PATENT DOCUMENTS

| | | | | |
|---|---|---|---|---|
| D33,763 | S | 12/1900 | Meinecke | |
| 1,468,072 | A | 9/1923 | Millas | |
| 2,374,580 | A | 4/1945 | Brown | |
| 2,405,484 | A * | 8/1946 | Bailhe | 441/127 |
| 3,065,476 | A | 11/1962 | Brown | |
| 3,152,343 | A | 10/1964 | Brown | |
| 3,167,794 | A | 2/1965 | Brown | |
| 3,371,363 | A | 3/1968 | LeBlanc, Jr. | |
| 3,528,116 | A | 9/1970 | Fenar | |
| 3,727,249 | A | 4/1973 | Bonthelius | |
| 3,763,972 | A | 10/1973 | Karzmar | |
| 3,988,795 | A | 11/1976 | Robertson | |
| 4,157,134 | A | 6/1979 | Stoll | |
| 4,190,918 | A | 3/1980 | Harvell | |
| 4,193,153 | A | 3/1980 | Tyrer et al. | |
| D255,966 | S | 7/1980 | Stadel | |
| 4,578,814 | A | 3/1986 | Skamser | |
| 4,671,393 | A | 6/1987 | Rainey | |
| D294,159 | S | 2/1988 | Foresman | |
| 4,802,233 | A | 1/1989 | Skamser | |
| 4,822,309 | A | 4/1989 | Vandenberg | |
| 4,843,662 | A | 7/1989 | Handelman | |
| 4,934,973 | A | 6/1990 | Taylor | |
| D311,808 | S | 11/1990 | Chvilicek | |
| 4,980,939 | A | 1/1991 | Smith | |
| D325,114 | S | 4/1992 | Reed | |
| 5,249,999 | A | 10/1993 | Steger | |
| 5,335,882 | A | 8/1994 | Bonacci | |

(Continued)

OTHER PUBLICATIONS www.pfdsavers.com.

(Continued)

*Primary Examiner*—Daniel V Venne

(57) ABSTRACT

A cushion-type personal flotation device saver includes: (a) a generally rectangular shaped main portion comprising two closed, opposite sides, a closed end, and an open end opposite the closed end; (b) at least one main strap attached to the main portion, the main strap comprising at least one grab strap; (c) a releasable closure mechanism attached along at least one edge of the open end of the main portion; (d) a central chamber within the main portion, the chamber being accessible at the open end of the main portion; and (e) a removable collared insert that fits closely within the main portion chamber, the collared insert being slidable into and out of the main portion chamber. A combination personal flotation device saver and personal flotation device is also included. This simplified abstract is not intended to limit, and should not be interpreted as limiting, the scope of the claims.

18 Claims, 7 Drawing Sheets

U.S. PATENT DOCUMENTS

| | | | | |
|---|---|---|---|---|
| 5,342,109 | A | | 8/1994 | Berry et al. |
| D366,383 | S | | 1/1996 | Briegleb |
| D366,800 | S | | 2/1996 | Moore, Jr. |
| 5,551,108 | A | * | 9/1996 | Butler, III ..... 5/655 |
| 5,566,410 | A | | 10/1996 | Schaechter |
| 5,702,153 | A | | 12/1997 | Pliska |
| 5,775,967 | A | | 7/1998 | Lacoursiere et al. |
| 5,785,568 | A | | 7/1998 | Lake |
| D413,733 | S | | 9/1999 | Edmonds |
| 6,018,143 | A | | 1/2000 | Check |
| 6,089,936 | A | | 7/2000 | Hoffman |
| 6,152,527 | A | | 11/2000 | McDowell |
| 6,281,477 | B1 | | 8/2001 | Forrester et al. |
| 6,568,976 | B2 | | 5/2003 | Anderson |
| 6,820,938 | B2 | | 11/2004 | Barrett |
| 7,034,254 | B2 | | 4/2006 | Grabowski et al. |
| 7,052,211 | B1 | | 5/2006 | Curry |
| 7,059,924 | B2 | | 6/2006 | Farmer et al. |
| 7,255,621 | B2 | | 8/2007 | Deslauriers |
| 7,266,852 | B2 | | 9/2007 | Davis |
| D601,844 | S | | 10/2009 | Miller |
| 2007/0135005 | A1 | | 6/2007 | Whitney |
| 2007/0164014 | A1 | | 7/2007 | Saadoun |
| 2007/0287343 | A1 | | 12/2007 | Deville et al. |
| 2008/0090476 | A1 | | 4/2008 | Hamburg |
| 2008/0311808 | A1 | | 12/2008 | Oneill et al. |

OTHER PUBLICATIONS

US Coast Guard "Think Safe: Choose the Right Personal Flotation Device", Item 000-BO-006 PPPC/150000/08-08, pp. 1-16, USA. http://www.uscgboating.org/safety/life_jacket_wear_wearing_your_life_jacket.aspx, 3 pages.

* cited by examiner

CUSHION PERSONAL FLOTATION DEVICE SAVER

BACKGROUND OF THE INVENTION

1. Technical Field

The present invention relates to a cushion-type personal flotation device saver that can be used in combination with a personal flotation device as a seat cushion on a boat or dock bench, for example, or thrown to a swimmer in the water in a potential emergency situation for use as a personal flotation device, or the personal flotation device inside the personal flotation device saver can easily be removed and used by a person in distress.

2. Background Information

An estimated 17 million old personal flotation devices (called "PFDs" herein) are discarded every year in the United States. The US Coast Guard and most states require that old, non-serviceable PFDs be taken out of service. "Non-serviceable" means that the PFD must not be used for service as a life saving device, since it may fail. Often, the outer fabric of the PFD has deteriorated and therefore may fail to hold intact the life saving fill material inside it. PFDs are designed to keep a person afloat during an emergency. Torn, worn, rotten, and deteriorated PFD fabrics can put the user's life in peril in an emergency situation.

Secondly, old PFDs cause disposal problems. In a landfill, they are generally not biodegradable and can last for hundreds of years. Old PFDs that are channeled into garbage disposal systems are often burned along with other garbage, which can release hazardous fumes into the environment. If they are not properly disposed of, old PFDs are a hazard to wildlife. A device that protects any PFD, old or new, preserves it against the elements, such as wind and rain, and sun, and thus helps to protect the environment from the adverse effects of old discarded units.

The combination of the personal flotation device saver (hereinafter "PFD saver") of the present invention and a universal life preserver inserted in it is itself a life preserver that is capable of meeting US Coast Guard requirements. Normally, if a life preserver is placed within a hand-sewn cover, for example, it is considered non-accessible and therefore would not qualify for use as a life preserver. In a home sewn cover, the PFD would be discounted as ineffective by the US Coast Guard and other state law enforcement agencies. The PFD saver combination of the present invention actually becomes a comparable or better product in comparison with the PFD that has been inserted in it. For instance; a cushion-type PFD saver of the present invention with a Type II PFD inserted in it becomes a dual purpose Type II and Type IV PFD. Meanwhile, the enclosed PFD is protected, giving it an extended lifespan. The PFD savers of the present invention extend the life of enclosed PFDs indefinitely, thus helping to stop the damage being done to the environment caused by discarding old, non-usable products.

The present PFD saver is intended to help protect the environment against discarded "non-serviceable" PFDs and to keep new PFDs in new condition for a longer period. The PFD savers will be replaced over time instead of replacing the PFDs themselves. Old PFDs can be utilized in a new way by inserting them in PFD savers.

When the protective cushion-type PFD saver of the present invention encloses a universal Type II PFD, the combination PFD saver/Type II PFD is available for immediate use as a Type IV PFD. Secondly, the PFD saver can be opened at the user's discretion and the Type II PFD can quickly be extracted and used as a conventional Type II PFD. The PFD saver can alternatively hold a Type I PFD. The PFD saver of the present invention is especially beneficial for those boaters who refuse to wear a life jacket; since it will be close at hand in its double function as a seat cushion, rather than being stowed below deck or somewhere else that is not as accessible as a seat cushion. Thirdly, when the protective cushion-type PFD saver of the present invention encloses a Type IV PFD, the saver combination is available for immediate use as a Type IV PFD.

BRIEF SUMMARY OF THE INVENTION

The present invention is a cushion-type personal flotation device saver ("PFD saver"), which comprises: (a) a generally rectangular shaped main portion comprising two closed, opposite sides, a closed end, and an open end opposite the closed end; (b) at least one main strap, an attached section of the at least one main strap being attached to the main portion, the main strap comprising at least one grab strap; (c) a releasable closure mechanism attached along at least one edge of the open end of the main portion; (d) a central chamber within the main portion, the chamber being accessible at the open end of the main portion; and (e) a removable collared insert that fits closely within the main portion chamber, the collared insert being slidable into and out of the main portion chamber. The PFD saver has an open position in which the closure mechanism is open, and a closed position in which the closure mechanism is closed. The PFD saver of the present invention preferably also includes: (f) a locking mechanism adjacent the open end of the main portion; and (g) a locking mechanism storage pocket. The PFD saver is preferably in combination with a PFD.

Advantages of the cushion-type PFD savers of the present invention include the following:

1) They protect new or other serviceable PFDs from the effects of weather and the ultraviolet rays of the sun, and from wear and tear.
2) They allow old, weathered, or worn (non-serviceable) PFDs to be utilized in lieu of being burned in incinerators or discarded in landfills or inappropriate locations, where they can be a hazard to wildlife. This helps to protect the environment. As the PFD saver of the present invention fails over time, it can be replaced and the like-new PFD inside it gets a second life, then a third, and so forth.
3) Where the PFD is a Type II PFD, the collared insert facilitates insertion, removal, and storage of the Type II PFD in the PFD saver. The collared insert also provides cushioning and comfortable seating when the PFD saver/PFD combination is used as a seat cushion on a boat seat or bench seat, for example. More importantly, the PFD saver/PFD combination can be thrown to a person in the water in a potential emergency situation for use as a Type IV PFD. Where the PFD saver is itself a Type IV PFD, the combination is immediately available as a Type IV PFD, or the interior PFD can be removed from the PFD saver and used as a Type II PFD to help a person in distress stay afloat in the water.
4) The collared insert and the liner in the PFD saver, if any, can be fabricated from used foam fill material from old PFDs, so long as the recycled fill material is still sufficiently buoyant to meet requirements. This helps to conserve resources and protect the environment.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
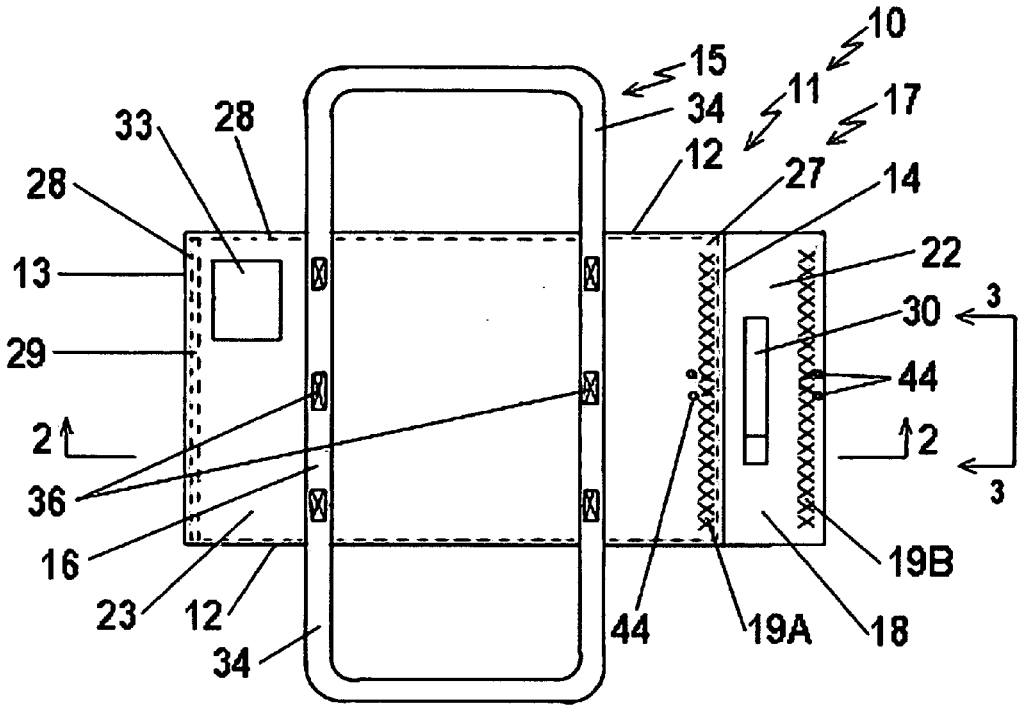
FIG. 1 is a top plan view of a cushion-type PFD saver according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, a PFD saver embodying the principles and concepts of the present invention and generally designated by the reference numeral 10 will now be described.

Turning first to FIGS. 1 through 8B, a cushion-type PFD saver 10 comprises: a) a generally rectangular-shaped main portion 11 comprising two closed, opposite sides 12, a closed end 13, and an open end 14 opposite the closed end 13; b) at least one main strap 15, an attached section 16 of which is attached to the main portion 11; c) a releasable closure mechanism 17 attached along the edges of the open end 14 of the main portion 11; d) a central chamber 39 in the main portion 11, the chamber 39 being accessible via the open end 14 of the main portion 11; and e) a removable collared insert 24 that fits closely within the main portion 11. The collared insert 24 slides into and out of the main portion chamber 39. The PFD saver 10 preferably also includes: (f) a locking mechanism 40; and (g) a locking mechanism storage pocket 30. The word "rectangular-shaped" herein is meant to include square-shaped right angle parallelograms.

Figure 8A:
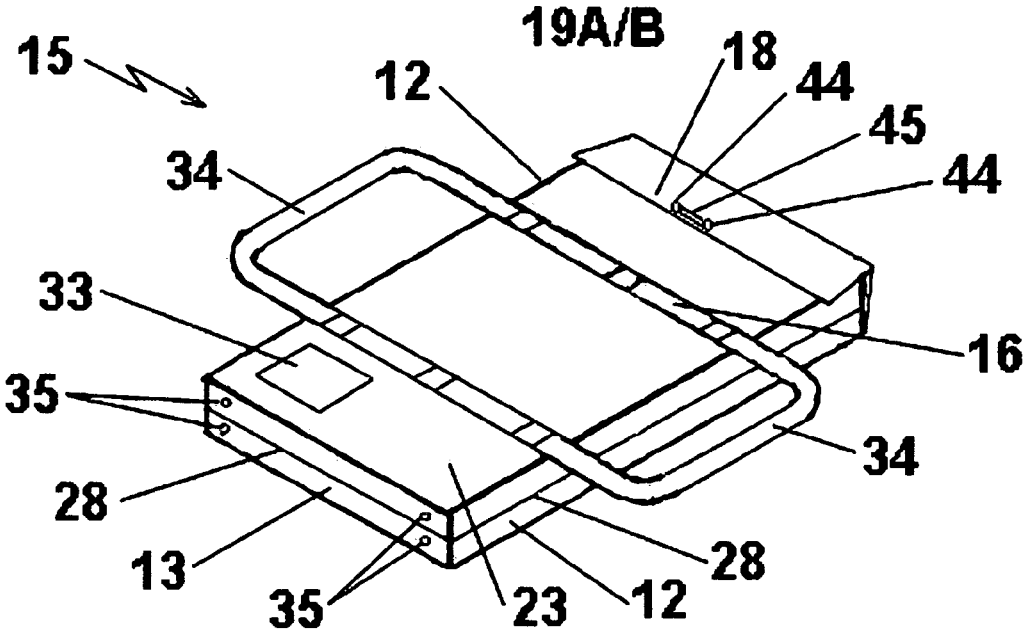
FIG. 8A is a top perspective view of a cushion-type PFD saver according to the present invention, shown in a closed position.
Figure 8B:
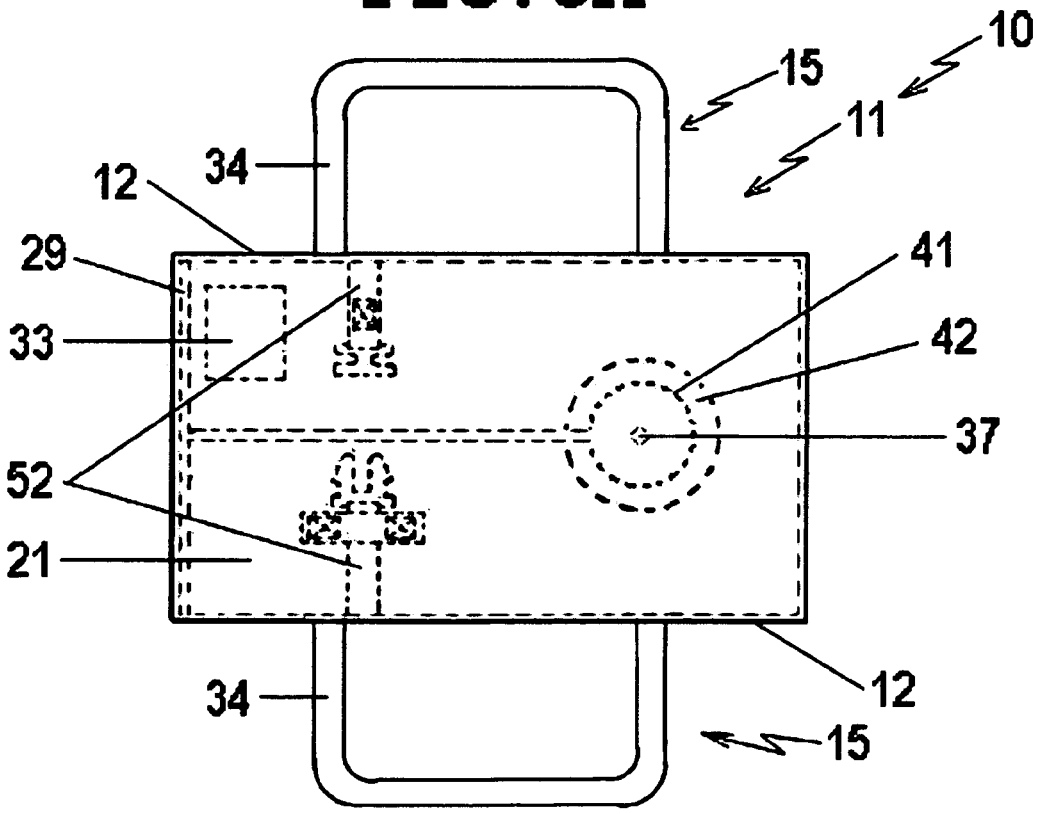
FIG. 8B is a bottom plan view of a cushion-type PFD saver according to the present invention, shown with an outlined Type II PFD in it.

The cushion-type PFD saver 10 is ready for use once a Type II personal flotation device ("PFD") 21 has been inserted into it, as seen in outline in FIG. 8B, through the open end 14. The cushion-type PFD saver 10 functions to protect the Type II PFD 21 within it. The PFD saver/Type II PFD combination is available for immediate use as a Type IV PFD 55, or the Type II PFD 21 can be removed from the PFD saver 10 and used in the water, as needed.

The edges of the closed sides 12 and the closed end 13 of a bottom section 22 of the main portion 11 are preferably attached to corresponding edges of the closed sides 12 and closed end 13 of a top section 23 of the main portion 11. The edges of the closed sides 12, and the closed end 13, are preferably sewn together at side/end seams 28. An end flap 18 of the bottom section 22 extends beyond the open end edge 27 of the open end 14 of the top section 23 when the main portion 11 is in the open position, so that the end flap 18 can be flapped over the open end edge 27 of the top section 23 to close the main portion 11. Thus, the bottom section 22 of the main portion 11 is longer than the top section 23.

Alternatively, the main portion 11 is made from one, single layer piece of cloth that has been folded in two transversely, with one end of the cloth forming the single layer end flap 18. In the one piece main portion, the closed end 13 does not require a seam; only the two opposite, longitudinal sides 12 are sewn closed. The bottom and top sections 22, 23 of the main portion 11 are preferably substantially the same size as one another.

The main portion 11 is closed once the PFD 21 has been inserted in the PFD saver 10. The releasable closure mechanism 17 is preferably a number of hook and loop strips. Preferably, the backs of first hook and loop strips 19A, or first parts of another closure mechanism, are attached along the outside surface of the edge 27 of the open end 14 of the top section 23. The backs of corresponding hook and loop strips 19B, or second parts of another closure mechanism, are attached to an inside surface of the bottom section 22 along the end flap 18. The PFD saver 10 has an open position with the end flap 18 extended and the open end 14 open for receiving a PFD 21, and a closed position with the collared insert 24 in the main portion 11, the end flap 18 extending over the open end edge 27, and the hook and loop strips 19 of the closure mechanism attached to one another.

The main strap 15 is preferably one closed loop with a middle segment 16 on each side of the main strap attached to the top section 23 of the main portion 11. The middle segment 16 of the main strap 15 is attached to the outside surface 31 of the top section 23 of the main portion 11, preferably by sewing. The middle segment 16 of the main strap 15 may be attached at one or more strap attachment sites 36 along the main strap. In the PFD saver 10 depicted in FIGS. 1 and 4, the middle segment 16 is attached to the top section 23 at three strap attachment sites 36. Grab strap segments 34 at the ends of the main strap 15 extend beyond the opposite sides 12 of the main portion 11. Each main strap 15, then, preferably includes same sized middle segments 16, each with at least one strap attachment site 36, and same sized grab strap segments 34 at opposite ends of the middle segments. The main strap 15 is preferably made of cotton, polyester, and/or nylon material.

To use the PFD saver/PFD combination in the ocean or other body of water, the user can place one arm through each grab strap segment 34 of the combination device, and hug the central main portion 11 against his or her chest. Either the top section 23 or the bottom section 22 of the main portion 11 can be pressed against the user's chest. If desired, the user can wrap his or her arms around the main portion 11 and lean on it as the user floats in the water. When the PFD saver 10 is not in use, the grab strap segments 34 hang loosely on either side of the main portion 11. The main strap 15 can be used to pick up the PFD saver/PFD combination on a boat or on a dock, for example, and throw it in the water. The main strap 15 is also useful for grabbing the floating PFD saver/PFD combination and pulling it to the user when the user is in the water.

Figure 4:
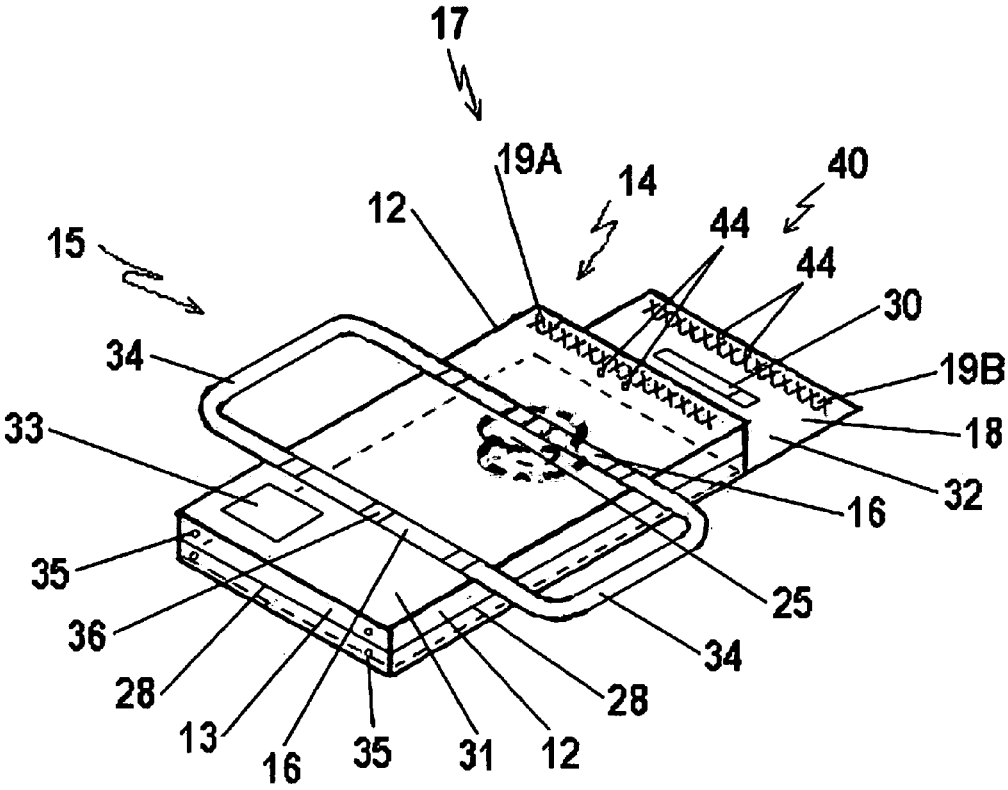
FIG. 4 is a perspective view of a cushion-type PFD saver according to the present invention, shown in an open position.

A patch 33 bearing a logos or seal may be attached to an outside surface 31 of the main portion 11, as seen in FIGS. 1 and 4. The patch 33 preferably bears a US Coast Guard seal and is sewn or adhered to, or printed directly on, a lower corner, or the center, of the top section 23 of the PFD saver 10.

The main portion 11 of the PFD saver 10 is preferably made of a long lasting, UV (ultraviolet rays) resistant, outdoor, substantially flexible and breathable, sturdy material, such as a nylon-containing fabric, that has been approved by the US Coast Guard. The main portion 11 is preferably fluorescent orange or red, as desired by the end user. The preferred two one layer pieces are substantially the same size as one another.

As seen in FIG. 4, the main portion 11 includes a number of drain holes 35, preferably in the closed end 13 of the main portion, so that water, if any, can drain out from the inside of the main portion 11. Each drain hole 35 is preferably surrounded by a rust-resistant grommet.

Figure 2:
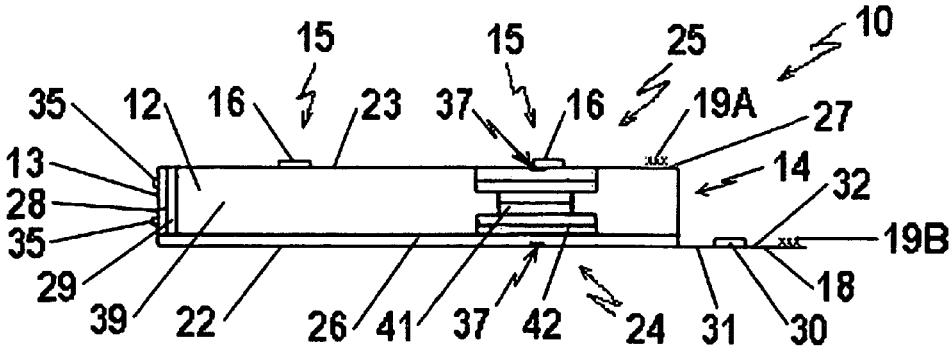
FIG. 2 is a cross-sectional view of the cushion-type PFD saver of FIG. 1, taken across line 2-2.
Figure 5:
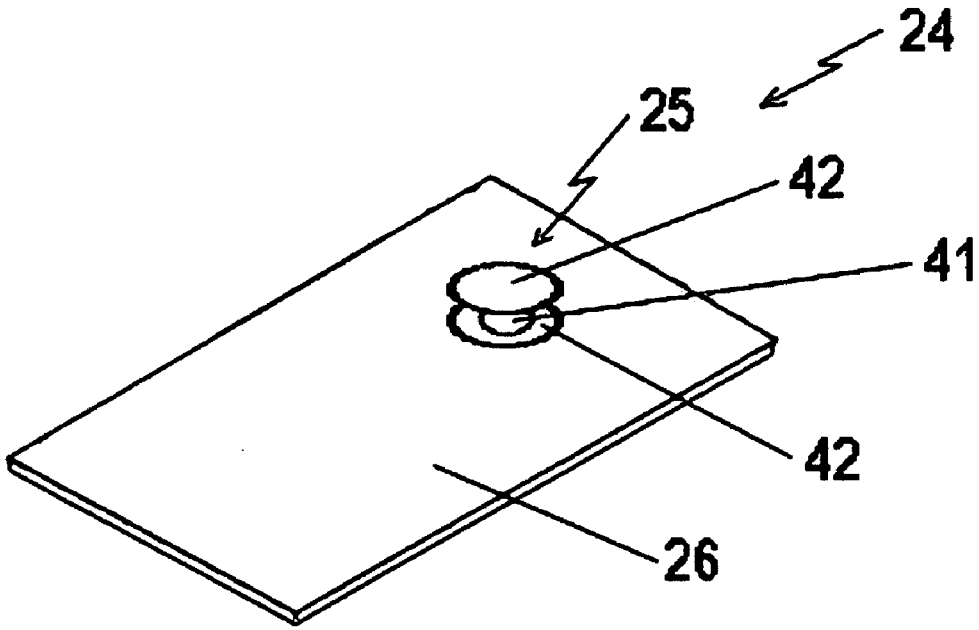
FIG. 5 is a perspective view of a collared insert of a cushion-type PFD saver according to the present invention.

Referring to FIGS. 2, 4, and 5 in particular, the cushion PFD saver 10 further includes: the removable, collared insert 24, which slides into the chamber 39 in the main portion 11. The end flap 18 can be closed over the collared insert 24 once the collared insert 24 is in the main portion 11. The collared insert 24 preferably includes: (a) a bobbin-shaped support collar 25, and (b) a substantially rectangular and planar base 26 to which the support collar 25 is affixed by means of a collar fastener device 37, as seen in FIG. 5. As seen in FIG. 2, the height of the support collar 25 plus the thickness of the insert base 26 under it preferably approximately equals the height of the main portion chamber 39, so the collared insert 24 slides closely through the open end 14 and into the main portion chamber 39.

The support collar 25 is preferably bobbin-shaped and includes an indentation (see edge of 41) that holds the PFD neck 43 in place on the insert base and within the main portion chamber. As illustrated in FIGS. 5 and 6, the bobbin-shaped support collar 25 preferably includes a central, circular shaped axle-type disk 41 that is sandwiched between two circular-shaped outer disks 42. The same sized outer disks 42 have a larger diameter than the central axle disk 41. The bottommost outer disk 42 is sandwiched between the central axle disk 41 and the insert base 26, as seen in FIG. 6A.

Figure 6A:
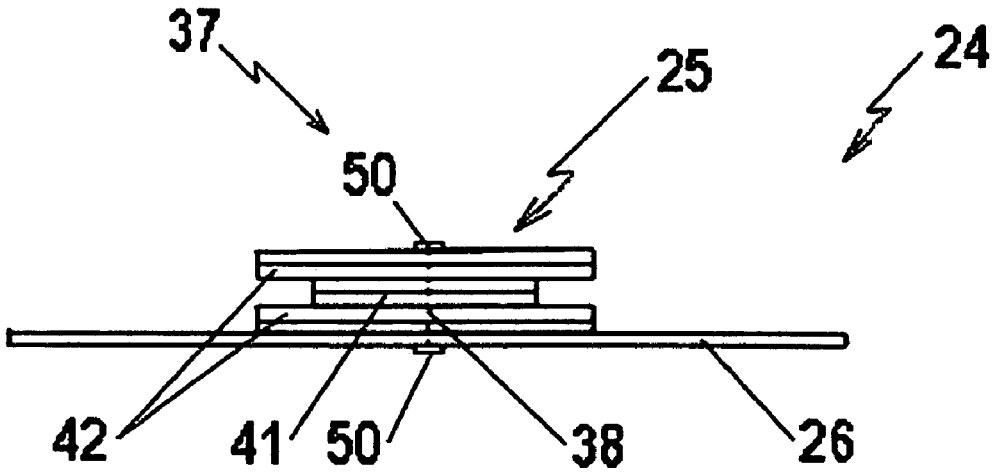
FIG. 6A is an end view of a collared insert of a cushion-type PFD saver according to the present invention.

The collar fastener device 37 extends through the center of the support collar 25 and through the insert base 26 under the support collar, as depicted in FIG. 6A. The collar fastener device 37 can be a pin with a head attached at each end of the pin fastener. The pin fastener and its heads are preferably made of plastic. The collar fastener 37 alternatively includes a cord connector 38 with washers 50 attached to the opposite ends of the cord connector, as seen in FIG. 6A. Preferably, a nylon cord connector is threaded through the center of the disks 41, 42 using a needle, and the washers 50 are tied onto the cord connector once the needle is removed. A first one of the washers 50 contacts a top surface of the support collar 25, and an opposite, second one of the washers 50 contacts a bottom surface of the insert base 26. The collar fastener washers 50 are preferably made of brass, stainless steel, or plastic.

Figure 7:
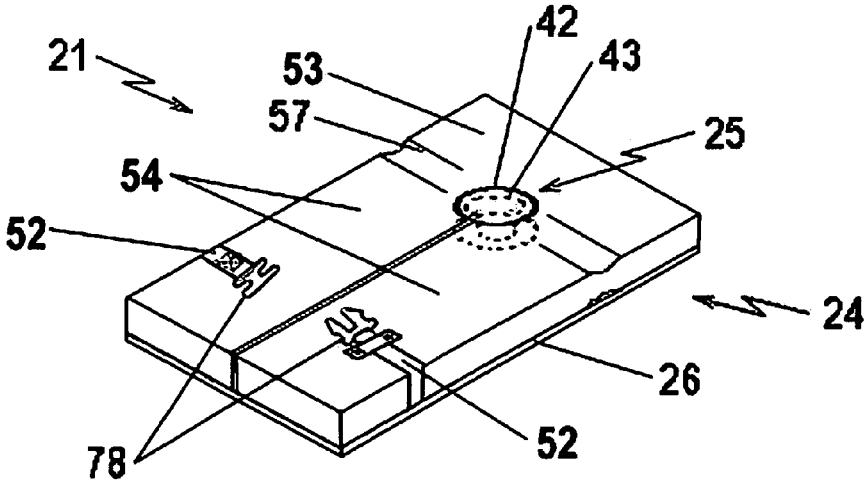
FIG. 7 is a perspective view of a collared insert of a cushion-type PFD saver according to the present invention, shown with a Type II PFD on it.

The collared insert 24 facilitates insertion and storage of the Type II PFD 21 in the PFD saver 10. The support collar 25 holds the Type II PFD in place on the insert base and in the PFD saver 10, and facilitates removal of the PFD 21 from the PFD saver 10 and insertion of the PFD and the collared insert into the PFD saver. As depicted in FIG. 7, the neck hole 43 of the Type II PFD 21 is placed over the support collar 25 of the collared insert 24. The rear of the Type II PFD contacts the top of the insert base 26, with the pillow section 53 of the vest PFD 21 around the collar 25 resting on the insert base 26, and the rear of the two tail sections 54 of the vest PFD 21 also resting side by side on the insert base 26. Referring to FIG. 7, flexible creases 57 may be seen between the relatively flexible PFD pillow section 53 and the PFD tail sections 54. The length and width of the insert base 26 is about the same as the length and width of the Type II PFD. The thickness of the Type II PFD plus the thickness of the insert base 26 is approximately the same as the height of the PFD saver chamber, so that the PFD fits closely within the PFD saver 10.

The whole PFD neck 43 is held by the two outer disks 42 of the support collar 25. The diameter of the collar inner axle disk 41 is approximately the same as the diameter of the hole within the neck of the PFD. The material of the tightest part of the neck 43 of the PFD contacts the inner axle disk 41, which holds the PFD in place on the insert base 26. The PFD neck 43 is held closely by the support collar 25. The waist strap 52 of the PFD 21 (see FIG. 7) with its waist strap buckle portions 78 also fit within the PFD saver 10 when the PFD 21 on the collared insert 24 is slid into the saver chamber 39 (see FIG. 8B).

The support collar 25 provides an even surface, cushioning, and comfortable seating when the PFD saver/PFD combination is used as a seat cushion on a boat seat or bench seat, for example. Instead of an empty space where the PFD neck hole is within the PFD saver 10, the user sits on the smooth cushion of the combination device. The insert base 26 also provides additional cushioning, evenness, and comfort for when the PFD saver/PFD combination is used as a seat cushion. For example, the insert base 26 covers the vertical gap, or through slit, between the sides of the chest portion in the front of the Type II PFD 21 within the PFD saver 10.

The collared insert 24 can be placed in the main portion 11 with the support collar 25 facing the top section 23 (up) as seen in FIGS. 2 and 4, or the bottom section 22 (down) as seen in FIG. 8B. The collar insert 24 can be slid into the main portion 11 with its collar 25 end closer to the closed end 13 of the main portion 11 as seen in FIG. 7, or closer to the open end 14 as seen in FIGS. 2 and 4. Once the PFD is removed from the PFD saver, it is taken off the support collar 25 and insert base prior to using the PFD. The support collar and insert base are not part of the PFD.

The support collar 25 and insert base 26 are preferably made of a closed cell foam material. In addition to being lightweight, sturdy, comfortable, and floatable, closed cell foam material is often used to fill conventional PFDs. Importantly too, the collared insert 24 is preferably fabricated using the used closed cell foam filling from at least one discarded PFD, which also helps to preserve the environment, if the filling is still sufficiently buoyant to meet requirements. To assemble the collared insert 24, the preferred closed cell foam outer and inner disks 41, 42 are first stacked on one another and the support collar 25 is placed in the middle of an end portion of the closed cell foam insert base 26 where the PFD neck 43 goes when the PFD is lined up on the insert base. Then the collar fastener device 37 is a one headed pin that is preferably inserted through the closed cell foam disks 41, 42 and the second head is placed on the opposite end of the pin fastener, as seen in FIG. 6A. The PFD saver 10 can be fabricated in several sizes to accommodate different sized Type II PFDs: adult, youth, & child. The collar fastener device 37 may be a nylon cord sewn through the closed cell foam disks instead of a pin, with a washer attached at each end of the nylon cord connector.

The insert base 26 can be placed above and below the PFD, each piece being one-half the required thickness of the insert, rather than just being below the PFD. Additional pieces are believed to add flexibility to the combination device. It is believed that the foam parts must yield a minimum of 4.5 pounds buoyancy in order to meet government requirements.

Figure 6B:
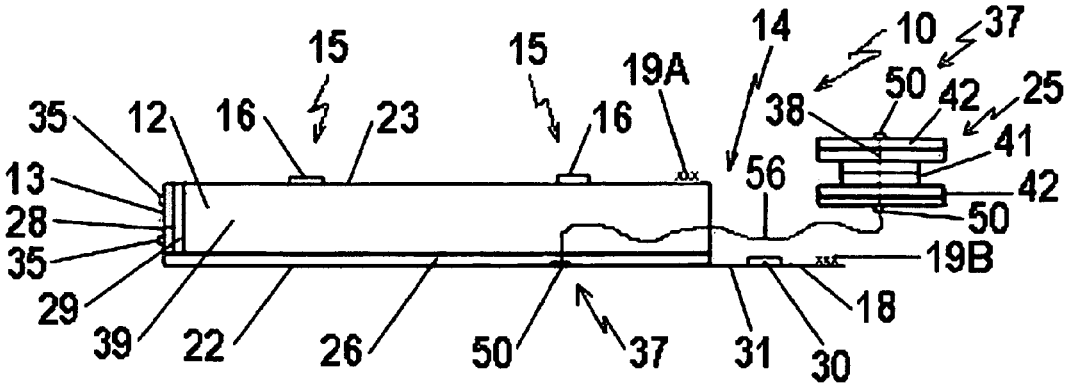
FIG. 6B is a cross-sectional view of the cushion-type PFD saver of FIG. 1, taken across line 2-2 and shown with an alternate, tethered collar.

In the alternate PFD saver 10 shown in FIG. 6B, the insert base 26 is attached to the bottom section of the PFD saver 10 within the PFD saver rather than being removable, and the support collar 25 is removable and tethered. One end of the collar tether 56 is fastened to the insert base 26 just inside the saver main portion chamber 39, preferably at the collar fastener device 37, and the opposite end of the tether 56 is attached to the collar fastener device 37 on the support collar 25. A washer 50 is preferably fastened at each end of the collar fastener device 37, which is preferably a nylon cord threaded through the foam disks 41, 42. The tether 56 of the support collar 25 is sufficiently long for the support collar 25 to be pulled well out of the PFD saver. The tether is preferably between about one and two feet long.

Continuing with FIG. 6B, the bobbin-shaped tethered support collar 25 includes a central, circular shaped axle-type disk 41 sandwiched between two circular-shaped outer disks 42. The same sized outer disks 42 have a larger diameter than the central axle disk 41. The bottommost outer disk 42 is sandwiched between the central axle disk 41 and the insert base 26, as seen in FIG. 6B. The collar fastener device 37 extends through the center of the support collar 25. The collar fastener device 37 can be a pin with a head attached at each end of the pin, or alternatively, a cord connector 38 with washers 50 attached to the opposite ends of the cord connector. Preferably, a nylon cord connector 38 is threaded through the center of the disks 41, 42 using a needle, and washers 50 are tied onto the cord connector once the needle is removed.

To place the PFD in the PFD saver, the tethered support collar 25 is taken out of the PFD saver 10 through the open end 14 of the main portion and inserted in the neck hole of the PFD. When the tethered collar is in the PFD, the two outer disks 42 of the support collar 25 support the PFD neck 43. The diameter of the collar inner axle disk 41 is approximately the same as the diameter of the PFD neck hole. The material of the tightest part of the neck 43 of the PFD contacts the inner axle disk 41 of the collar, which holds the PFD in place in the PFD saver. The PFD neck 43 is held closely by the support collar 25. The PFD and the tethered collar are then inserted in the PFD saver 10, with the tether line also in the saver chamber. The rear of the PFD contacts the top of the insert base 26, with the pillow section 53 of the vest PFD 21 around the support collar 25 resting on the insert base 26. Removal of the PFD 21 from the PFD saver 10 and insertion of the PFD in the PFD saver are thus facilitated. The support collar 25 also provides cushioning in the neck hole and helps maintain the shape of the PFD over time. Once the PFD is removed from the PFD saver, the tethered collar 25 is removed from the PFD neck hole prior to using the PFD. The support collar is not part of the PFD. The support collar 25 and its tether 56 are stored within the saver.

With continued attention to the cushion PFD saver 10 shown in FIGS. 1-8, the Type II PFD 21 can be permanently closed in the PFD saver 10, if desired. Permanent closure of the PFD saver 10 is desirable where, for example, the Type II PFD is old and not reusable for its original intended purpose. The PFD saver 10 may include hook and loop locking holes 44, preferably surrounded by grommets, for this purpose, as seen in FIGS. 1 and 8. The PFD saver 10 preferably includes two of the hook and loop locking holes 44 in the top section 23 of the main portion 11, and two hook and loop locking holes 44 correspondingly placed in the end flap 18 of the bottom section 22 of the main portion 11. Once the Type II PFD 21 is placed in the PFD saver 10, the end flap 18 is closed and a locking strip 45 or other appropriate seal is inserted through corresponding hook and loop locking holes 44 and sealed. If required, the locking strip 45 can be cut by authorities in order to open and inspect the PFD saver 10. A plastic or nylon tie wrap locking strip is preferred. Suitable alternate locking mechanisms 40 may be employed in place of the locking strip 45. If the PFD is new or like new, no locking mechanism is necessary.

As seen in FIGS. 1, 2, and 8B, the PFD saver 10 may also include an optional weight strip 29 to add a small amount of weight at one end of the PFD saver. In addition to bringing the weight of the combination up to a required government standard, if any, it is believed that the small amount of additional weight added by the weight strips 29 makes the PFD saver/PFD combination easier to throw accurately to someone in distress in the water. An accurate toss can mean the difference between life and death in some circumstances. The weight strip 29 is preferably straight and made of recycled plastic. The weight strip 29 preferably weighs between about four and about ten ounces. It is preferably installed in the closed end 13 of the main portion 11 within the chamber 39.

Figure 9:
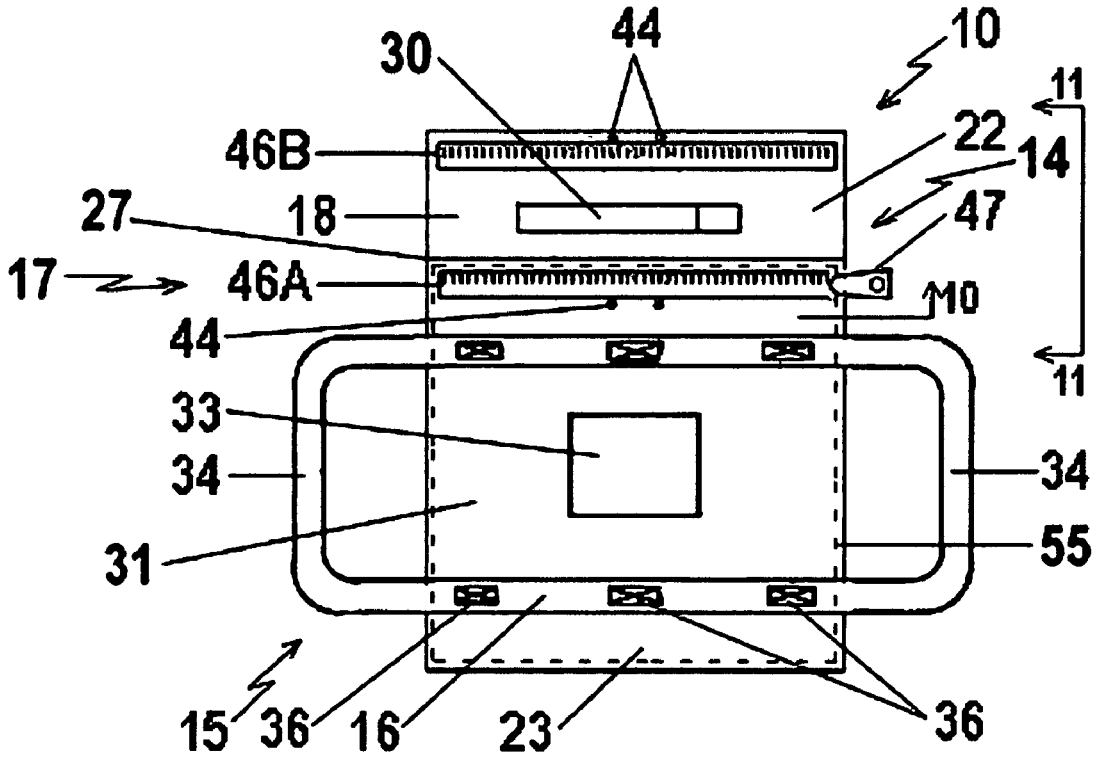
FIG. 9 is a top plan view of a second, zippered cushion-type PFD saver according to the present invention, shown in an open position.
Figure 10:
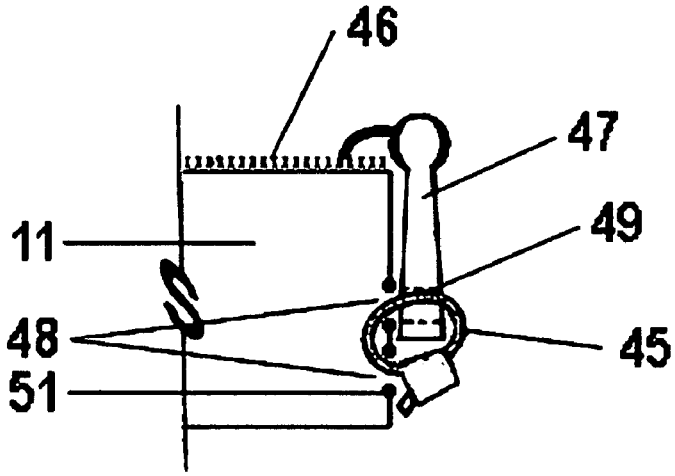
FIG. 10 is a sectional view of a zipper pull area of the zippered cushion-type PFD saver of FIG. 9, taken across line 10-10 and shown in a locked position.
Figure 11:
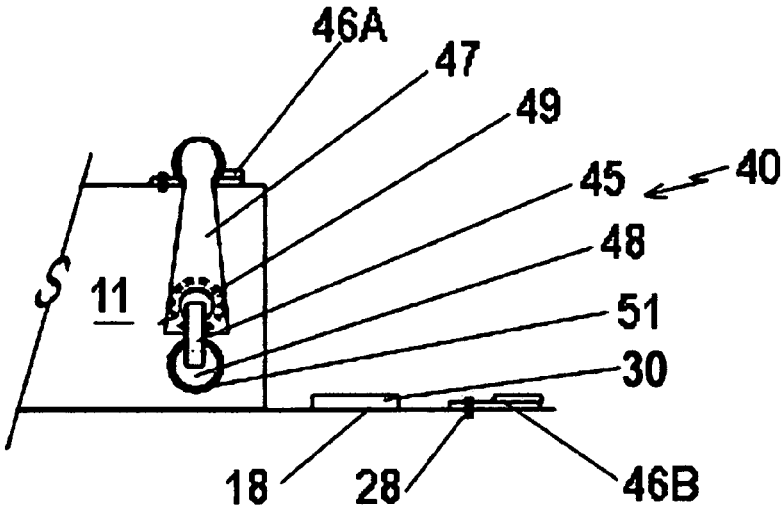
FIG. 11 is a sectional view of a zipper pull area of the zippered cushion-type PFD saver of FIG. 9, taken across line 11-11 and shown in a locked position.

Turning now to FIGS. 9 through 11, a zipper closure mechanism can be used instead of hook and loop strips to close the open end 14 of the main portion 11. As seen in FIG. 9, a first portion 46A of a zipper 46, such as an upholstery zipper, is attached on the outside surface 31 along the edge 27 of the open end 14 of the top section 23. A corresponding, second portion 46B of the zipper 46 is attached to the inside surface 32 of the bottom section 22 along the end flap 18. As seen in FIG. 9, the PFD saver 10 has an open position with the end flap 18 extended and the open end 14 open for receiving a PFD 55. The PFD saver 10 also has a closed position with the PFD 55 enclosed in the main portion 11, the end flap 18 folded over the open end edge 27, and the two portions of the zipper 46 zipped together.

If desired, the zipper 46 can be permanently closed by inserting a locking strip 45 (preferably nylon) through a hole 49 in a zipper pull 47 of the zipper and at least one and preferably two zipper pull locking holes 48 in the main portion 11. The locking strip 45 is then sealed. This is advisable when the PFD is non-serviceable. The zipper pull 47 is shown in a locked position from the end of the main portion 11 in FIG. 10, and the side of the main portion 11 in FIG. 11. The end flap of the PFD saver is shown in an open position in FIG. 11 only for purposes of illustration.

Figure 3:
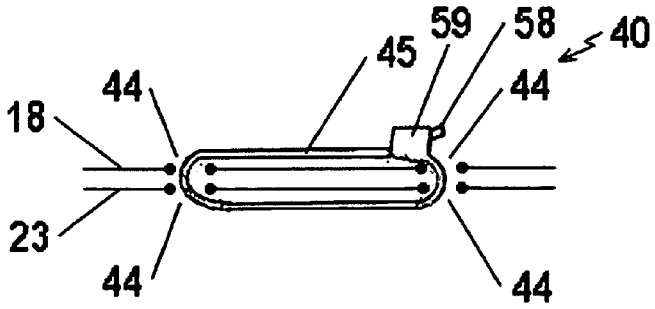
FIG. 3 is a cross sectional view of a locked locking mechanism of the cushion-type PFD saver of FIG. 1, taken across line 3-3.

If desired, the sealed plastic locking strip 45 can be cut in order to open the PFD saver 10. Authorities, such as US Coast Guard personnel, may find it necessary to do so in order to inspect the PFD within the PFD saver 10. Hook and loop locking holes 44 are used when the PFD saver 10 includes the hook and loop strips. Each locking hole 44, 48 in the top section 23 of the main portion 11 is preferably surrounded by a grommet 51.

Where the PFD saver closure mechanism 17 is a zipper, the cut locking strip 45 is easily replaced by removing a replacement locking strip from the locking mechanism storage pocket 30 adjacent the zipper 46, inserting it through the zipper pull locking holes 48 and the hole 49 in the zipper pull 47 of the zipped up zipper, and sealing the replacement locking strip 45, which is preferably a tie wrap. The storage pocket 30 is preferably located just inside the zipper pull area, where it is protected and can easily be accessed (see FIGS. 11 and 12). The storage pocket 30 accommodates spare locking strips where the locking mechanism 40 of the PFD saver 10 includes a locking strip 45.

Where the PFD saver closure mechanism 17 is hook and loop strips 19, the storage pocket 30 is preferably attached on the end flap 18 just below the row of hook and loop strips 19B, as seen in FIGS. 1 and 4. On the end flap, the storage pocket 30 can easily be accessed, yet is protected when the PFD saver 10 is in the closed position. If it has been cut, the locking strip 45 of the locking mechanism 40 can easily be replaced by removing a replacement locking strip from the storage pocket 30 on the end flap, and inserting it through the two sets of hook and loop locking holes 44, as illustrated in FIG. 3, while the PFD saver 10 is in the closed position. The replacement locking strip 45 is then sealed. Where the locking strip 45 is a preferred tie wrap, it is sealed by inserting the end 58 of the tie wrap through the locking loop 59 on the tie wrap and pulling it (see FIG. 3).

The PFD saver 10/PFD combination is preferably sealed with an outdoor quality zipper with grommets and a locking mechanism 40. As described herein and shown in the figures, hook and loop strips 19 can be substituted for the parts of the zipper 46. A locking mechanism 40 comprising four grommets and a locking seal can be used, as shown in FIG. 3. A locking mechanism 40 is employed where the PFD in the PFD saver 10 is non-serviceable. A PFD saver 10 holding a new or as new PFD, which can be removed and used, does not require a locking mechanism.

Figure 12:
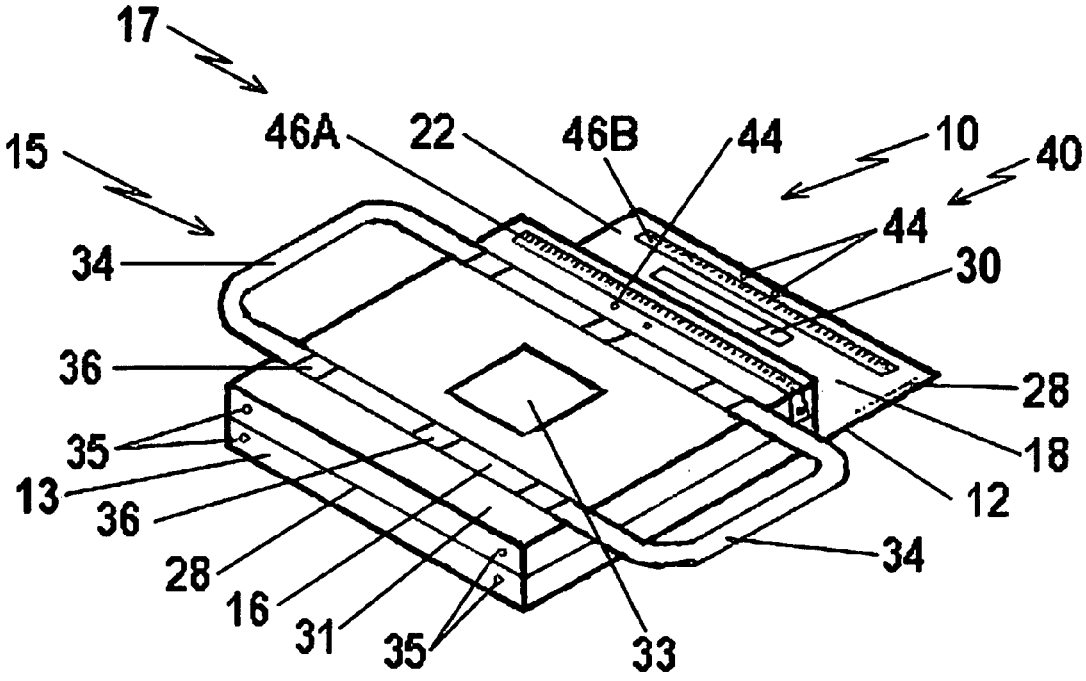
FIG. 12 is a perspective view of a collarless cushion-type PFD saver according to the present invention, shown in an open position.

Turning to FIG. 12, a zippered cushion-type PFD saver 10 without a collar insert can be used to house a Type IV PFD 55. Both the PFD saver 10 and the Type IV PFD 55 in it are substantially square-shaped. The PFD saver/Type IV PFD combination can itself be used as a seat cushion or a personal flotation device. Alternatively, the end flap 18 can be opened and the Type IV PFD 55 can be removed from the PFD saver 10 and used, if the PFD is in serviceable condition. When the PFD saver 10 holds a non-serviceable PFD, the PFD is sealed in the PFD saver 10. This can be done using a locking strip as described and shown herein, in which case the end flap 18 is permanently sealed shut.

In the PFD saver 10 for a Type IV PFD 55, a first portion 46A of a zipper 46, such as an upholstery zipper, is attached on the outside surface 31 along the edge 27 of the open end 14 of the top section 23. A corresponding, second portion 46B of the zipper 46 is attached to the inside surface 32 of the bottom section 22 along the end flap 18. As seen in FIG. 12, the PFD saver 10 has an open position with the end flap 18 extended and the open end 14 open for receiving the Type IV PFD 55. The PFD saver 10 also has a closed position with the end flap 18 folded over the open end edge 27, and the two portions of the zipper 46 zipped together. When the PFD is non-serviceable, the zipper 46 is closed and locked using a sealed locking strip 45 extending through a hole 49 in a zipper pull 47 of the zipper and at least one and preferably two zipper pull locking holes 48 in the main portion 11. Hook and loop locking holes 44 can be used for a hook and loop closure.

An alternate version of the PFD saver 10 for the Type IV PFD 55 bears hook and loop strips 19 at the open end 14 of the main portion 11 instead of a zipper 46. In this hook and loop Type IV PFD saver 10, the hook and loop strips 19A, 19B have the same appearance and placement as the first and second zipper portions 46A, 46B shown in FIG. 12 without the zipper pull, and the hook and loop strips 19A, 19B, respectively, in FIGS. 1, 2, and 4.

In the PFD saver 10 for the Type IV PFD 55, a patch 33 is adhered to or printed on the center of the substantially square-shaped PFD saver 10, preferably on the top section 23 of the main portion 11 along with the main strap 15. The patch 33 preferably bears a US Coast Guard seal of approval/instructions for use. The substantially square-shaped PFD saver 10 can be stuffed with other suitable types of PFD fill, or with another type of suitable, lightweight, floatable, water-resistant fill material, as desired. Fill material must meet US Coast Guard specifications.

The PFD saver 10 preferably meets US Coast Guard and other applicable specifications, federal standards, and regulations. Foam parts meet USCG specification 164.015 type A or B. The grab strap 34 preferably finishes 20 inches long and 1 inch wide and has a breaking strength of at least 400 pounds. USCG 160.049-1 and Military Spec. MIL-W-530. Stitches and seams meet Federal Standard #751 and USCG 164.023. The minimum border on seams is preferably ⅜ inch. Stitches on the PFD saver 10 are preferably lockstitch at 7-9 per inch. Chain stitch with minimum 20/4 thread on top and 40/3 thread on bottom is allowed on grab straps.

The cushion-type PFD saver 10 is preferably made of ultraviolet-rated material and/or other materials, such as cotton, nylon, polyester, polyvinylchloride, denim, canvas, etc., that are suitable for the desired term of protection of the enclosed PFD. The PFD saver material is mildew resistant, drainable, and fast drying. Any heavy upholstery types of material used in the PFD saver 10 are porous or perforated and holes include grommets where necessary. Although Type II and Type IV PFDs are depicted herein, the PFD savers 10 may be used to enclose other suitable types of PFDs as well, such as a Type I PFD.

The combination PFD saver/PFD includes a PFD and the PFD saver 10 described herein, which comprises: (a) a generally rectangular shaped main portion 11 comprising two closed, opposite sides 12, a closed end 13, and an open end 14 opposite the closed end 13; (b) at least one main strap 15, an attached section 16 of the main strap being attached to the main portion, the main strap 15 comprising at least one grab strap 34; (c) a releasable closure mechanism 17 attached along the edges of the open end 14 of the main portion 11; and (d) a central chamber 39 within the main portion 11, the chamber 39 being accessible at the open end 14 of the main portion 11. The PFD is enclosable in the PFD saver 10. The PFD is preferably a Type II PFD 21 or a Type IV PFD 55. Most preferably, there is a grab strap 34 on each longitudinal side of the PFD saver, with opposite ends of each grab strap 34 being attached to a longitudinal side of the PFD saver 10. The PFD is not folded within the PFD saver 10, and is easy to insert in the PFD saver and remove from the PFD saver. The PFD need not fold or include a hinge in order to fit in the PFD saver 10. Neither the PFD saver 10 nor the PFD have arm holes. The PFD saver 10 is lightweight, durable, and easy to store when it is not in use.

When the PFD is a Type II PFD 21, the PFD saver 10 in the combination further comprises: (e) the removable collared insert 24 that fits closely within the main portion 11 (see description herein). Where the PFD is Type II, the combination is itself useable as a Type IV PFD, and the Type II PFD 21 is removable from the PFD saver 10 and useable as a Type II PFD. The support collar 25 is preferably bobbin-shaped with an indentation (edge of 41) that supports the neck 43 of the PFD 21. The collared insert 24 preferably comprises: (a) a support collar 25, and (b) a substantially rectangular and planar base 26 to which the support collar 25 is affixed by means of a collar fastener. The PFD saver 10 preferably further comprises: (f) a locking mechanism 40 adjacent the open end of the main portion 11; when the PFD 21 is non-serviceable, the PFD saver 10 is locked in a closed position.

The PFD of the combination can alternatively be a Type I PFD, and the PFD saver 10 further comprises: (e) a removable collared insert 24 that fits closely within the main portion chamber. The combination is useable as a Type IV PFD, and the Type I PFD is fully enclosed by the PFD saver 10 and is removable from the PFD saver and useable as a Type I PFD. Again, a neck 43 of the Type I PFD fits closely around the support collar 25, and a rear portion of the Type I PFD contacts the insert base 26 (see FIG. 7). A Type I PFD has the same general appearance as the Type II PFD 21 shown in FIG. 7. A Type I PFD is ordinarily intended for use in the ocean, so it has more fill than a thinner Type II PFD, which is frequently used in coastal areas, lakes, and the like. The thicker Type I PFDs are often worn by passengers during ocean-going cruise safety drills. It is understood that some adjustments in size and shape to the PFD saver may be necessary.

In the case where the PFD of the combination is a Type IV 55, the PFD saver 10 preferably further includes the locking mechanism 40 on the main portion 11, and the PFD saver/PFD combination is itself usable as a Type IV PFD. It includes the hook and loop material 19 or the zipper 46 as the closure mechanism 17. The Type IV PFD 55 may be non-serviceable and locked inside the PFD saver 10. The PFD saver 10 may include a removable weight strip 29 attached to an inside of the closed end within the main portion chamber 39.

From the foregoing it can be realized that the described device of the present invention may be easily and conveniently utilized as a personal flotation device saver. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 cushion-type PFD saver
11 main portion
12 closed sides of main portion
13 closed end of main portion
14 open end of main portion
15 main strap
16 strap middle segments
17 closure mechanism
18 end flap
19 hook and loop strips
21 Type II PFD
22 bottom section of main portion
23 top section of main portion
24 collared insert
25 support collar
26 insert base
27 open end edge
28 seams
29 weight strip
30 locking mechanism storage pocket
31 outside surface of main portion
32 inside surface of main portion
33 patch
34 grab strap segments
35 drain holes
36 strap attachment site
37 collar fastener
38 nylon connector
39 main portion chamber
40 locking mechanism
41 inner, axle disk of collar
42 outer disks of collar
43 PFD neck
44 hook and loop locking holes
45 locking strip
46 zipper
47 zipper pull
48 zipper pull locking holes
49 hole in zipper pull
50 collar fastener washers
51 grommet
52 PFD waist strap
53 PFD pillow section
54 PFD tail sections
55 Type IV PFD
56 collar tether
57 flexible creases
58 end of locking strip
59 locking loop of locking strip
78 waist strap buckle portions

What is claimed is:

1. A cushion personal flotation device saver, comprising: (a) a generally rectangular-shaped main portion comprising two closed, opposite sides, a closed end, and an open end of the main portion opposite the closed end; (b) at least one main strap, an attached section of the at least one main strap being attached to the main portion, the main strap comprising at least one grab strap; (c) a releasable closure mechanism attached along at least one edge of the open end of the main portion; (d) a central chamber within the main portion, the chamber being accessible at the open end of the main portion; and (e) a removable collared insert that fits within the main portion chamber, the collared insert being slidable into and out of the main portion chamber; wherein the personal flotation device saver has an open position in which the closure mechanism is open, and a closed position in which the closure mechanism is closed.

2. The personal flotation device saver according to claim 1, further comprising: (f) a locking mechanism adjacent the open end of the main portion.

3. The personal flotation device saver according to claim 2, wherein the closure mechanism is at least one zipper and the locking mechanism comprises a locking strip; the at least one zipper being closed and locked using the locking strip when the closure mechanism is closed, the locking strip extending through a zipper pull hole in a zipper pull of the at least one zipper and at least one locking hole in the main portion.

4. The personal flotation device saver according to claim 1, wherein the collared insert comprises: (a) a support collar, and (b) a substantially rectangular and planar insert base to which the support collar is affixed.

5. The personal flotation device saver according to claim 4, wherein the support collar is bobbin-shaped, and comprises a central, circular-shaped axle disk sandwiched between two circular-shaped, same-sized outer disks, the outer disks having a larger diameter than the central axle disk, a bottommost one of the outer disks being sandwiched between the central axle disk and the insert base.

6. The personal flotation device saver according to claim 1, wherein an end flap of a bottom section of the main portion is extended over the open end of the main portion and the closure mechanism is closed when the personal flotation device saver is in the closed position, and the closure mechanism is open, and the open end and the main portion chamber are open, when the personal flotation device saver is in the open position.

7. The personal flotation device saver according to claim 1, wherein the main portion comprises a top section and a bottom section, the top section being attached to the bottom section of the main portion along at least two sides of the top and bottom sections, a first section of the closure mechanism being attached along the at least one edge of the open end of the top section of the main portion, and a corresponding, second section of the closure mechanism being attached to the bottom section of the main portion.

8. The personal flotation device saver according to claim 7, wherein the closure mechanism comprises a plurality of hook and loop strips, a first portion of the hook and loop strips being attached along an outside surface of the at least one edge of the open end on the top section of the main portion, a second, corresponding portion of the hook and loop strips being attached to an inside surface of the bottom section along an end flap of the main portion.

9. The personal flotation device saver according to claim 2, wherein the locking mechanism comprises a sealable locking strip that extends through at least one closure hole in a top section of the main portion, and at least one corresponding closure hole in an end flap of a bottom section of the main portion.

10. The personal flotation device saver according to claim 7, wherein the closure mechanism is a zipper, a first portion of the zipper being attached to an outside surface along the at least one edge of the open end of the bottom section, a corresponding, second portion of the zipper being attached to an inside surface of the bottom section along an end flap of the main portion.

11. The personal flotation device saver according to claim 4, wherein the collar is affixed by a collar fastener, the collar fastener comprising a cord connector and a washer attached at each opposite end of the cord connector, a first one of the washers contacting a top surface of the support collar, an opposite, second one of the washers contacting a bottom surface of the insert base.

12. The personal flotation device saver according to claim 4, wherein the at least one main strap is a closed loop comprising at least one attached, middle segment on each side of the main strap, and two matching segments of the at least one grab strap at opposite ends of the at least one middle segment, the main strap attached, middle segment being attached to a bottom section of the main portion, the grab strap segments of the main strap extending beyond the two opposite sides of the main portion.

13. A combination personal flotation device and cushion personal flotation device saver, the personal flotation device saver comprising: (a) a generally rectangular-shaped main portion comprising two closed, opposite sides, a closed end, and an open end of the main portion opposite the closed end; (b) at least one main strap, an attached section of the main strap being attached to the main portion; (c) a releasable closure mechanism attached along at least one edge of the open end of the main portion; and (d) a central chamber within the main portion, the chamber being accessible at the open end of the main portion; and further comprising a collared insert comprising: (1) a support collar, and (2) a substantially rectangular and planar insert base to which the support collar is affixed by means of a collar fastener; wherein the personal flotation device is enclosable in the personal flotation device saver.

14. The combination according to claim 13, wherein the collared insert is removable and fits within the main portion chamber; and wherein the personal flotation device is removable from the personal flotation device saver and useable as a personal flotation device.

15. A combination personal flotation device and cushion personal flotation device saver, the personal flotation device saver comprising: (a) a generally rectangular-shaped main portion comprising two closed, opposite sides, a closed end, and an open end of the main portion opposite the closed end; (b) at least one main strap, an attached section of the main strap being attached to the main portion; (c) a releasable closure mechanism attached along at least one edge of an open end of the main portion; and (d) a central chamber within the main portion, the chamber being accessible at the open end of the main portion; and further comprising a tethered support collar, and a non-removable insert base attached inside the personal flotation device saver, one end of the collar tether being fastened to the insert base, an opposite end of the collar tether being attached to the tethered support collar, the tethered support collar being removable from the personal flotation device saver central chamber and insertable in a neck hole of the personal flotation device; wherein the personal flotation device is enclosable in the personal flotation device saver.

16. The combination according to claim 13, the personal flotation device saver further comprising: a locking mechanism adjacent the open end of the main portion, and a locking mechanism storage pocket in the main portion; wherein the personal flotation device is non-serviceable, and the personal flotation device saver comprises two of the at least one grab straps, each grab strap being attached to a bottom section of the main portion.

17. The combination according to claim 13, wherein the support collar is bobbin-shaped and comprises an indentation that supports a neck of the personal flotation device, and the personal flotation device saver further comprises a removable weight strip attached to an inside of the closed end within the main portion chamber, and at least two drain holes in the main portion closed end.

18. The combination according to claim 13, wherein the personal flotation device saver further comprises a locking mechanism on the main portion, and the combination is itself a personal flotation device.

* * * * *